United States Patent [19]

Miller

[11] 4,257,511

[45] Mar. 24, 1981

[54] METHOD AND APPARATUS FOR SELECTIVE RECOVERY OF METAL CONTAINERS

[76] Inventor: John H. Miller, 10 Half Moon Way, Chandler, Ariz. 85224

[21] Appl. No.: 28

[22] Filed: Jan. 2, 1979

Related U.S. Application Data

[63] Continuation-in-part of Ser. No. 754,493, Dec. 27, 1976, Pat. No. 4,179,018.

[51] Int. Cl.[3] ..... G07F 1/06

[52] U.S. Cl. ..... 194/4 R; 100/45; 100/53; 100/99; 100/210; 100/295; 100/91; 100/DIG. 2; 177/2; 177/120; 209/10; 209/39; 209/631; 241/79.1; 241/99; 241/239; 241/242

[58] Field of Search ..... 100/45, 53, 99, 210, 100/295, DIG. 2, 91; 177/2, 114, 120; 194/4 D, 4 R; 209/10, 39, 629, 631; 241/99, 79.1, 239, 241, 242, 189, 81; 302/17, 59; 198/857

[56] References Cited

U.S. PATENT DOCUMENTS

| | | | |
|---|---|---|---|
| Re. 27,643 | 5/1973 | Myers | 100/DIG. 2 |
| 1,970,291 | 8/1934 | Everhard | 177/114 X |
| 1,985,563 | 12/1934 | Fitzgerald | 198/857 |
| 2,992,717 | 7/1961 | Putnam | 194/4 R |
| 3,159,259 | 12/1964 | Reece | 194/4 R |
| 3,487,450 | 12/1969 | Hubbard | 302/59 X |
| 3,687,062 | 8/1972 | Frank | 100/91 |
| 3,749,240 | 7/1973 | Spears | 209/631 |
| 3,792,765 | 2/1974 | Arp | 194/4 C |
| 4,084,496 | 4/1978 | Ehernberger | 100/91 X |
| 4,091,725 | 5/1978 | Arp | 100/45 |

*Primary Examiner*—Billy J. Wilhite

*Attorney, Agent, or Firm*—Gregory J. Nelson

[57] ABSTRACT

A method and apparatus for recovering metal containers of a selected type from a collection of trash is disclosed. The apparatus includes pneumatic and magnetic separators for removing extraneous debris. The separated containers are crushed and weighed. Compensation is issued in response to the weight of the separated containers. The separated containers are stored in an overhead compartment for collection and transportation.

2 Claims, 10 Drawing Figures

METHOD AND APPARATUS FOR SELECTIVE RECOVERY OF METAL CONTAINERS

The present application is a continuation-in-part of application, Ser. No. 754,493 entitled "Method and Apparatus For Selective Recovery of Metal Containers", now U.S. Pat. No. 4,179,018 issued Dec. 18, 1979.

The present invention relates to an apparatus for selectively recovering containers of a certain type from a collection of trash or refuse. More specifically, the present invention relates to an apparatus for segregating metal containers of a certain type from a mixed collection of containers and dispensing a form of compensation based on the weight of the segregated metal containers.

The use of non-reusable metal containers of various types to package foods and beverages has been widely accepted. Many products, particularly soft drinks and malt cereal beverages, are provided to the consumer in metal cans. Aluminum cans or containers provide particular advantages because of the relatively light weight of aluminum. Aluminum's resistance to corrosion and food contamination is also an important characteristic. Another advantage of aluminum is that aluminum cans or lids can be provided with tear or press tabs making them more convenient for use by the consumer.

With the increase in the use of non-reusable, metal containers, an attendant problem of littering has also become quite serious. Many consumers carelessly discard metal cans blighting the countryside. Consumer groups, beverage industry groups, governmental groups and others have attempted to meet this problem by establishing recycling centers which compensate individuals for aluminum containers brought to the recycling center. The returned aluminum cans can be recovered and refabricated into new cans thus reducing litter and conserving metal as a resource. However, even the establishment of recycling centers has not completely alleviated the problem as many people still carelessly throw away or discard used containers.

Therefore, there is a need for providing a process and apparatus for receiving and processing metal containers which would be convenient for the consumer and provide the necessary incentives so that consumers would be encouraged to collect and return empty containers.

A significant advance in the state of the art is disclosed in U.S. Pat. No. Re. 27,643, issued to Joseph D. Myers. The patent discloses a process and method for collection of metal containers which automatically dispenses tokens for each non-magnetic container stored. The Myers apparatus and process, while effective, does not separate selected containers from general refuse and trash. Extraneous material can cause the machine to completely stop. Further, compensation or tokens are dispensed in response to a count of non-magnetic containers processed rather than in relation to the weight of selected metal recovered by the apparatus.

Briefly, the present invention meets the requirements set out above and comprehends a method and apparatus for selectively recovering containers of a particular type from trash or refuse including containers of various types, such as steel, aluminum and glass. The method encompasses the steps of receiving assorted refuse and by successive steps of magnetic separation, pneumatic separation and classification, segregates the aluminum containers. Thereafter the aluminum containers are reduced in size by crushing or shredding and deposited on a weighing mechanism. A weighing mechanism determines the weight of the aluminum and actuates a mechanism for dispensing compensation in response to the weight of the material. After weighing the containers are conveyed to an appropriate holding or storage area for collection. The apparatus includes a hopper for receiving the materials which discharges onto a conveyor. A magnetic separator associated with the conveyor removes ferrous materials. Material discharged from the magnetic separator moves to a pneumatic conduit pressurized by a blower. The lighter, aluminum material is conveyed to a crusher and heavier trash, such as bottles, sand and dirt are removed from the conveyor by weight classification. A crusher, such as a rotary crusher, reduces the size of the containers and discharges them into a weighing hopper. Tokens, coupons, coins or other forms of compensation are dispensed in response to the weight of material weighed in the hopper. Periodically, the hopper is dumped into an air conveyor where the recovered, reduced containers are transmitted to an overhead storage area for collection. A control system operates to terminate input to the weighing hopper during a predetermined weighing cycle. The issuance of compensation, weighing, operation of conveyors and other control functions may be processed by a system including an analog circuit and a microprocessor.

The above and other objects and advantages of the present invention will become more apparent from a reading of the following specification, claims and drawings in which:

Figures 1, 3:
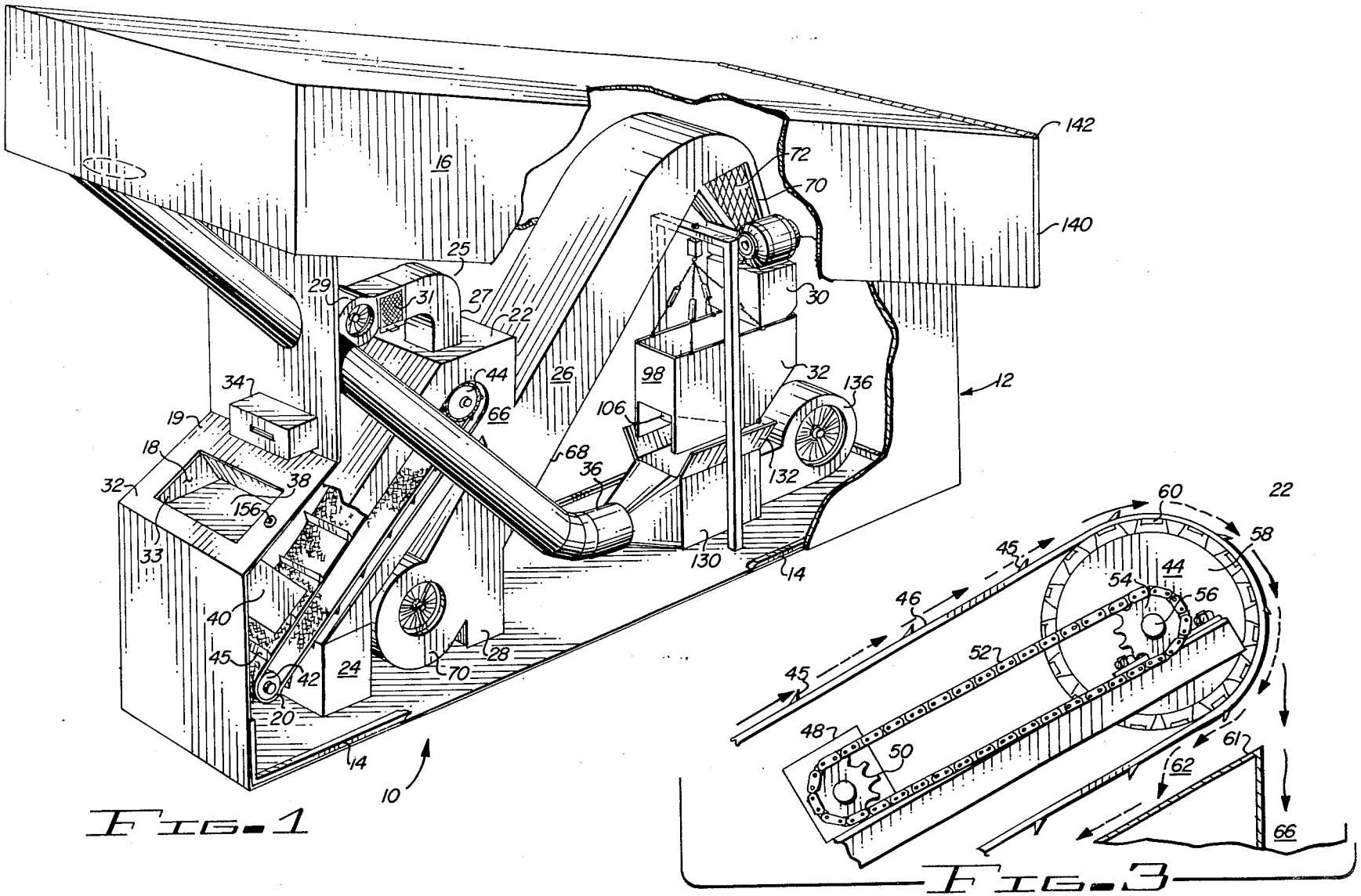
FIG. 1 is a perspective view of the collection apparatus of the present invention partly broken away to better illustrate the details of construction.
FIG. 3 is an enlarged detail view of a portion of the magnetic separation device.
Figure 2:
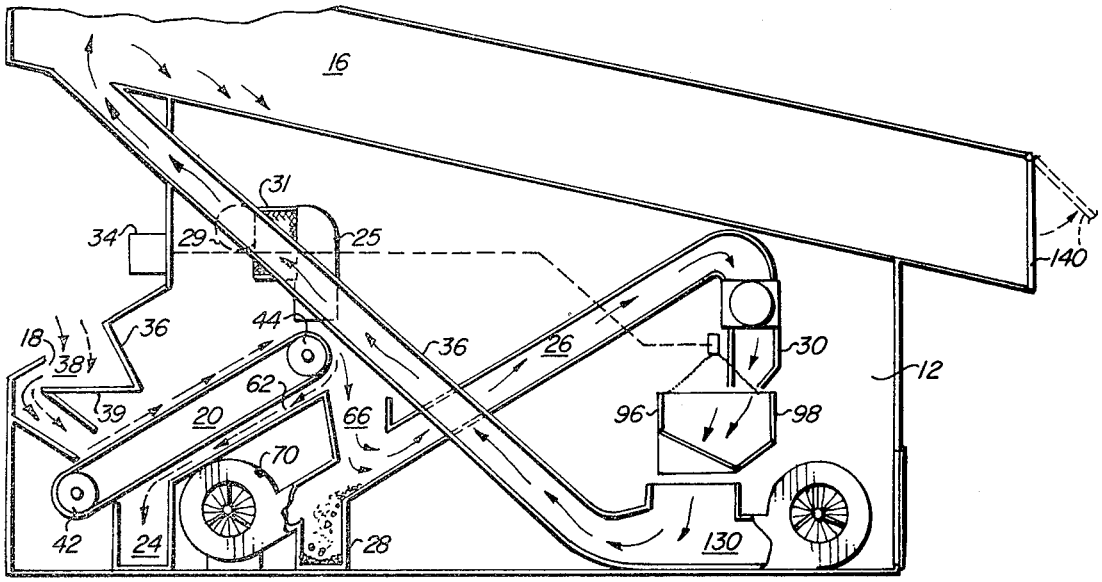
FIG. 2 is a simplified side elevational view of the collection apparatus of the present invention with the arrows indicating the flow path through the machine.

Turning now to the drawings, particularly FIGS. 1 and 2, the major components of the apparatus will be briefly described at the outset of the specification to assist in understanding the operation of the invention. The term "refuse" or "trash" as used throughout the specification and claims means a collection of discarded or waste materials and debris including containers or steel, aluminum, glass and the like. The apparatus is generally designated by the numeral 10 and includes a generally rectangular enclosure or housing member 12 supported on frame members 14. An inclined storage compartment 16 is supported on the top of enclosure 12. A hopper 18 is provided on inclined panel 19 at one end of enclosure 12 to receive assorted collected containers. Hopper 18 discharges onto an inclined conveyor belt 20. A magnetic separator 22 cooperates with the upper end of conveyor 20 to segregate ferrous materials. Ferrous materials are deposited in receptacle 24. Non-ferrous materials such as aluminum containers are discharged onto pneumatic conveyor 26 with the heavier, trash being separated by weight classification at chute 28. Lighter materials are removed by suction device 25. The aluminum containers are conveyed upwardly along pneumatic conveyor 26 and are discharged into a crusher 30. Subsequent to crushing, the aluminum or other segregated materials are discharged into weighing hopper 32. A coupon or other form of compensation is issued to the operator at dispenser 34 in response to the weight of material weighed in hopper 32. When the weighing cycle is completed, the weighed material is deposited into pneumatic conveyor 36 and transferred to overhead storage compartment 16.

The construction and operational details of the apparatus and method of the present invention will now be set forth in greater detail. The collection apparatus 10 has a generally rectangular housing or enclosure 12 supported on suitable frame members 14. The enclosure 12 may be fabricated from any suitable material such as panels of heavy gauge steel. Angular panel 31 is provided at one end of the enclosure 12 and defines a rectangular opening 33 which communicates with hopper 18. Hopper 18 has a rear wall 36 and a generally horizontal floor panel 39 forming sections 28 and 40 which form an acute angle with respect to one another. The reverse configuration of the hopper 18 prevents the user from extending a hand or arm into the machine thus reducing the possibility of injury to the user and effectively preventing tampering and vandalism.

The lower section of hopper 18 discharges onto the lower end of conveyor 20. Conveyor 20 includes lower conveyor drum 42 and an upper drum 44 which, as will be explained more fully hereafter, includes elements for magnetic separation. An endless conveyor belt 46 having transverse flights 45 is driven by gear motor 48 through sprocket 50, pintle chain 52 and sprocket 54. Sprocket 54 is secured to the shaft 56 of drum 44 and is adjustable by a conventional pillow block assembly.

As best seen in FIG. 3, drum 44 is generally cylindrical having a body 58 of non-ferrous material such as wood or plastic. A series of axially positioned magnetic bars 60 are positioned around the exterior of body 58. A separation plate 61 is positioned immediately below the conveyor drum 44 extending generally parallel to the conveyor belt 46 and forming a passageway 62 with the conveyor. The lower end of passageway 62 terminates at the receptacle 24. It will be apparent that ferrous material loaded onto conveyor belt 46 will magnetically be attracted to the elements 60 of drum 44. The magnetic field will exert this attractive force for at least 180 degrees of rotation so that the material will be held on the belt and deposited on the separation plate 61 and pass along passageway 62 and fall into receptacle 24. The non-ferrous material will, under the force of gravity, fall directly off the end of conveyor 46 into inlet 66 of pneumatic conveyor 26.

A suction or vacuum device 25 is mounted on conveyor housing 27 directly above the magnetic separator and includes suction fan 29 and inlet pipe 25. Light materials such as paper and plastics are picked up from conveyor 20 under the influence of the fan 29 and deposited in an appropriate receiving bin 31.

Pneumatic conveyor 26 includes an inclined, rectangular duct 68. A blower 70 at the lower end of duct 68 forces air through the duct. The blower can be of any conventional type and is shown as a centrifugal blower having a wheel mounted in a scroll-type housing. A chamber 28 is located at the discharge of blower 70 to receive heavier materials discharged into the conveyor 26. Weight classification is effected with such materials as grit, sand, rock, glass and other heavier debris falling into the receptacle 28. The remaining lighter materials consisting primarily of aluminum containers are pneumatically conveyed upwardly within pneumatic conveyor 26.

Figure 4:
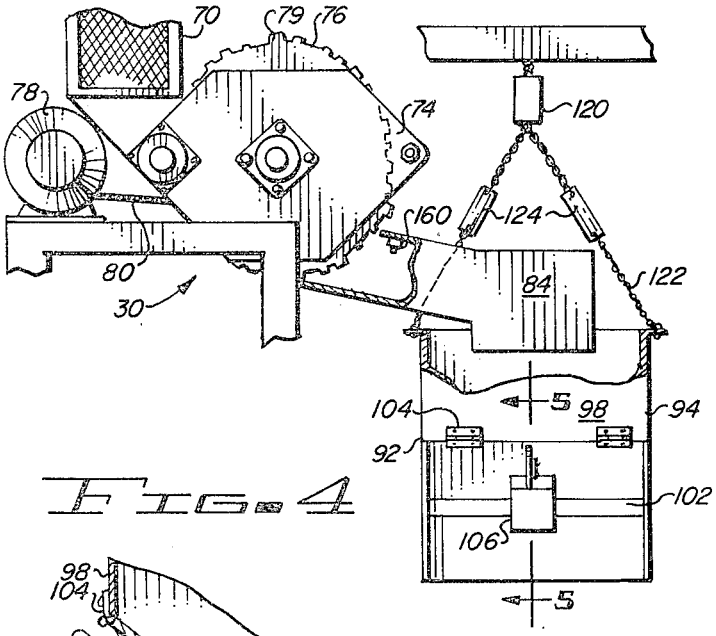
FIG. 4 is a detail view of the crushing and weighing components of the machine.
Figure 7:
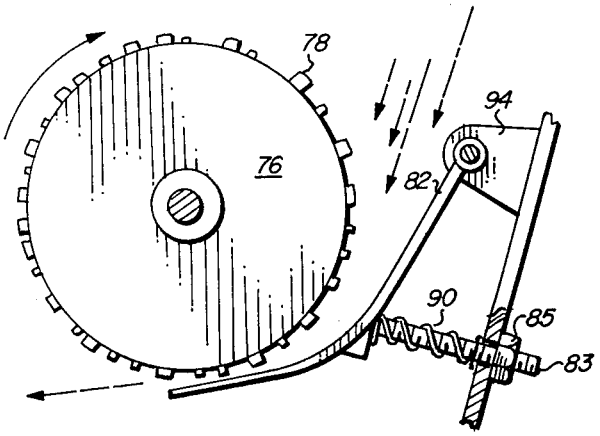
FIG. 7 is a detail view of the internal crushing mechanism.

A discharge nozzle 71 is positioned at the upper end of duct 68. Nozzle 70 has screen elements 72 permitting release of pressurized air from duct 68. Nozzle 70 discharges the lighter, segregated materials into crusher mechanism 30. Crusher mechanism 30, as best seen in FIGS. 4 and 7, includes a housing 74 which supports a cylindrical crushing member 76 for rotation in appropriate bearings. Crushing cylinder 76 is provided with a series of irregularly spaced and sized axial bars 79 which are of mild or, in some instances, hardened steel. Gear motor 78 rotatively drives crushing wheel 76 by means of chain drive 80. A semi-cylindrical mandrel plate 82 is closely spaced from crushing wheel 76. Materials deposited into the crusher mechanism 80 are reduced in size and crushed between the mandrel plate 82 and crushing cylinder 76 and deposited into chute 84. A limit switch 160 is positioned in chute 84 to sense discontinuance of material in process.

As best seen in FIG. 7, the position of the mandrel plate 82 relative to cylinder 76 may be adjusted. Mandrel plate 82 is pivotally secured to clevis 94 secured to the housing 74 of the unit. An adjustment bolt 83 extends through the housing having an adjusting nut 85 which may be taken up or backed off as required. A helical spring 90 extends between the housing and mandrel plate 82 and urges the plate toward the cylinder. The spring 90 maintains tension on plate 82 but will also serve to absorb shock imposed due to loading.

Figure 5A:
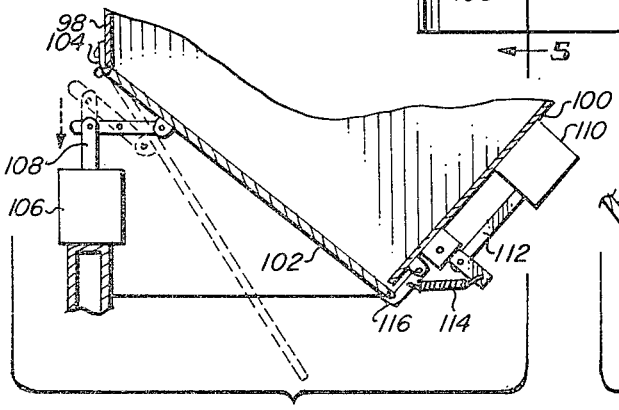
FIG. 5A is a sectional view taken along lines 5—5 of FIG. 4 showing the weighing hopper in a closed position.
Figure 5B:
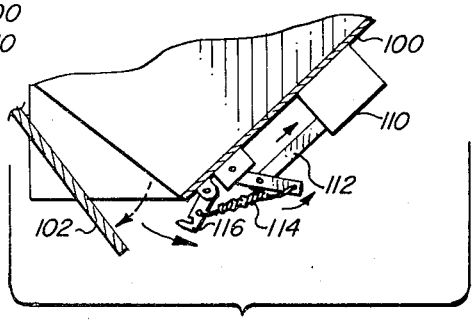
FIG. 5B is a sectional view taken along lines 5—5 of FIG. 4 showing the weighing hopper door in an open position with the latch actuated by the dumping solenoid.

The weighing mechanism includes a hopper 32 having opposite sidewalls 92 and 94 and end walls 96 and 98. The bottom of the hopper 32 is V-shaped having an inclined fixed plate 100 and a door 102 which is pivotally attached to end wall 98 by hinges 104. Door 102 will fall open due to gravity when latch 116 is disengaged from the edge of plate 100 as best seen in FIGS. 5A and 5B. Latch 116 is pivotally secured to plate 100 and is disengaged by action of latch or dump solenoid 110 through linkage 112 and spring 114. Latch 116 is normally biased to the closed position shown in FIG. 5A. Door 102 is returned to the closed position when the contents of hopper 32 have been dumped by actuation of hopper close solenoid 106 and linkage and roller 108. Extension of linkage 108 will pivot or return door 102 to the closed position. The actuation of solenoids 106 and 110 is controlled by an electrical circuit which will be described in more detail hereafter.

The weighing of the contents of the hopper prior to dumping is accomplished by a force measuring device such as a load cell 120 from which the hopper 32 and it's contents are suspended by chains 122. Load cell 120 may be of the type manufactured by Interface, Inc., of Scottsdale, Arizona, and designated as Model SM-100.

A dampening device 124, such as a spring or rubber insert is interposed in chains 122. As will be discussed with reference to the operation and control sequence of the apparatus, the contents of the hopper are periodically, incrementally weighed and upon completion of the weighing cycle discharged by opening of door 102.

The output from load cell 120 operatively controls a dispenser mechanism 34 located on the exterior of the machine. Dispenser 34 issues some form of compensation such as coupons, tokens, coins or cash to the user. The issuance of various types of compensation are within the scope of this invention such as coupons, tokens, coins or cash. Typically, dispenser 34 can be of the type such as a coupon dispenser manufactured by Akra Industries, Inc., of Del Monte, California. This dispenser issues stamps or coupons which are validated by perforation. Other types of validation of coupons can be used such as chemical or photo-chemical. The compensation dispensed is relative to the weight of material deposited in the machine and received in the hopper 32. If coins are dispensed, a multiple hopper dispensed, a multiple hopper dispenser such as the one designated model 6004 manufactured by Micro-Magnetic Industries of Palo Alto, California may be utilized.

Upon completion of the weighing cycle, door 102 is opened by actuating solenoid 110 to disengage latching hook 116. Door 102 falls or swings open under the influence of gravity and the weight of material within the hopper. The material falls into subjacent chamber 130. Chamber 130 is provided with angular side plates 132 to prevent material from falling outside of the chamber. A blower assembly 136 communicates with one side of chamber 130. The opposite side of chamber 130 is connected to circular, inclined duct 36. Duct 36 discharges into overhead storage compartment 16. The crushed, weighed material is pneumatically conveyed through duct 36 under influence of blower 136 into the overhead storage compartment 16. Storage compartment 16 is inclined with duct 36 discharging into the upper end of storage compartment 16. Material received within compartment 16 is periodically unloaded at door 140 which is hinged at 142. The position and inclination of compartment 16 facilitates unloading once door 140 is opened as gravity will cause the contained material to fall from the compartment into a bin or truck for collection. Door 140 is vented to release pressurized air in chamber 16.

Figure 6:
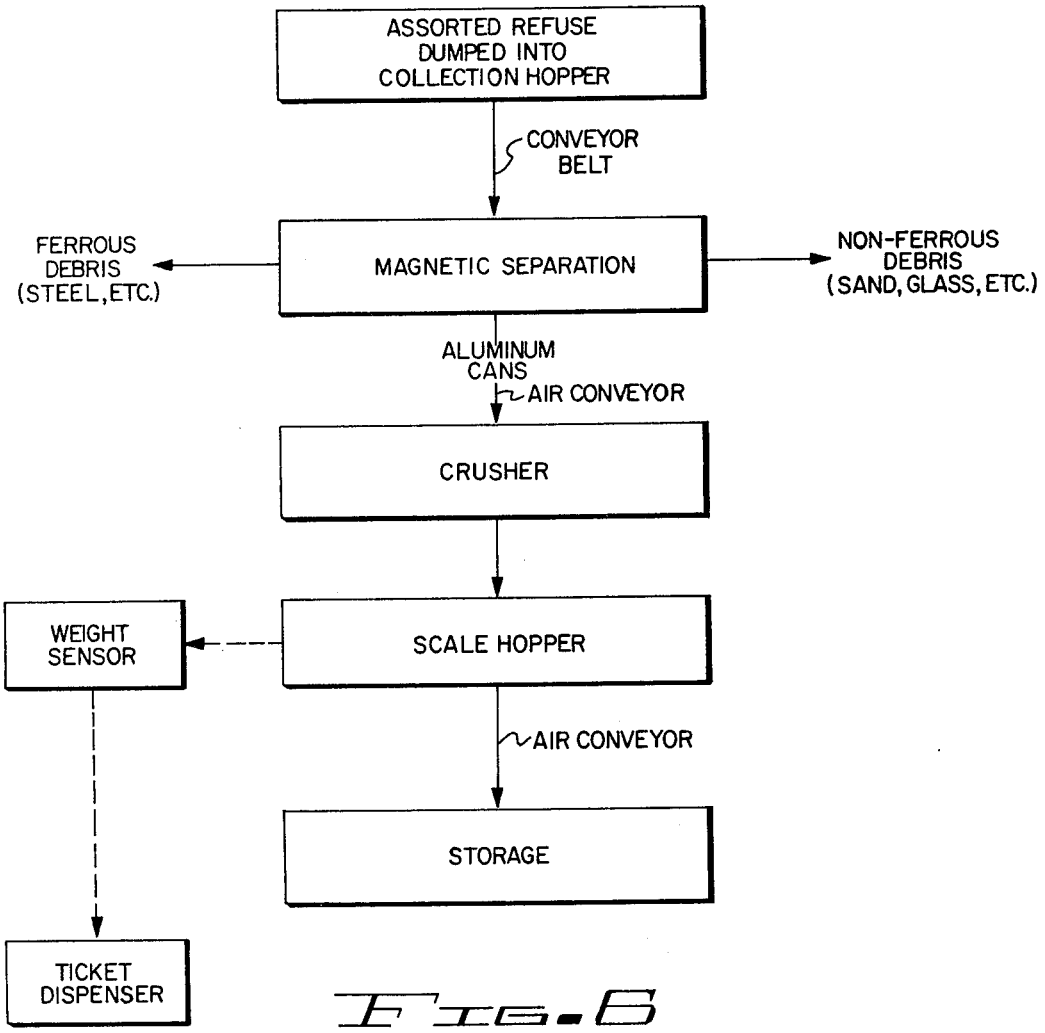
FIG. 6 is a schematic representation showing the process steps carried out by the apparatus of the present invention.
Figure 8:
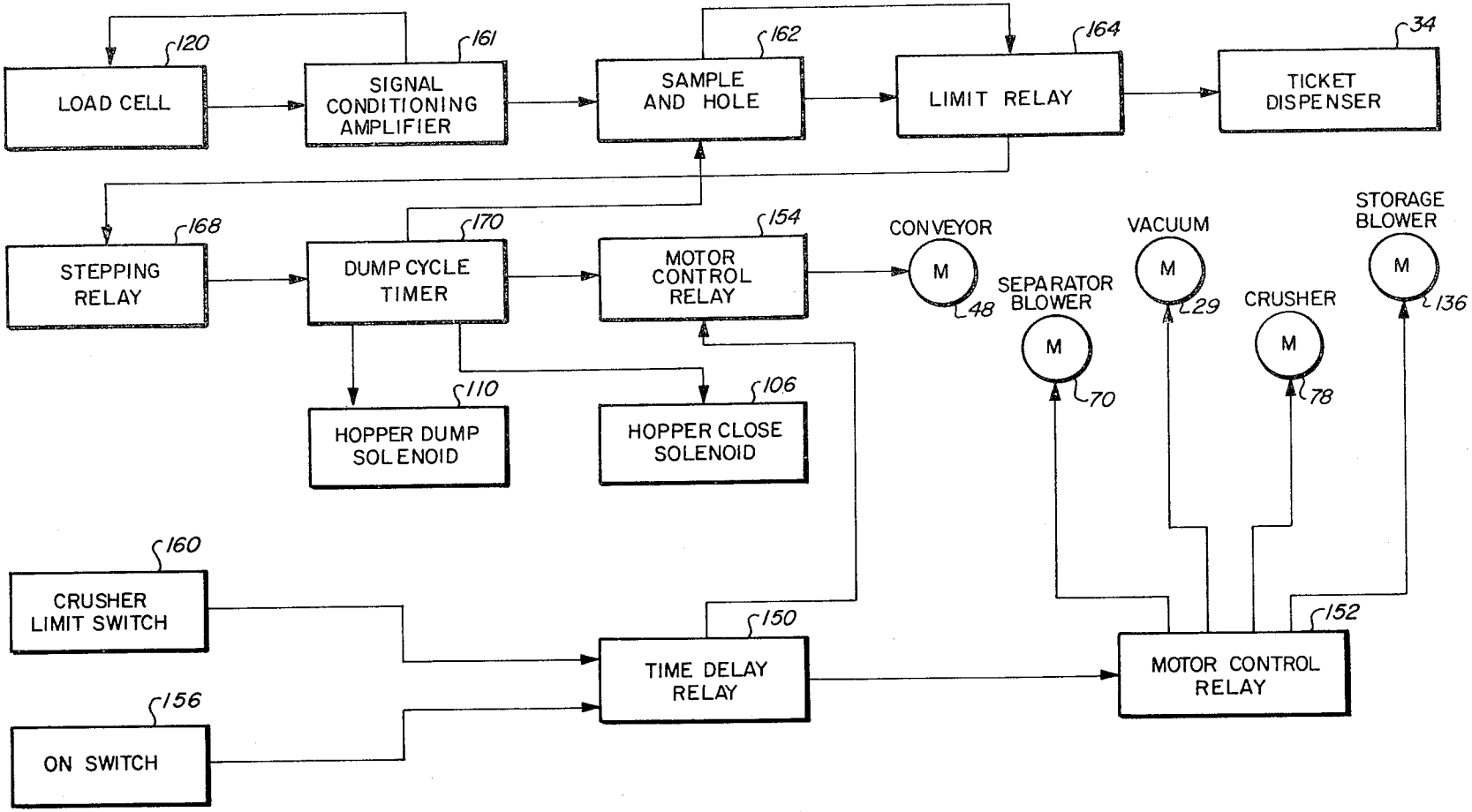
FIG. 8 is a schematic diagram illustrating the electrical control system of the collection apparatus of the present invention.

The apparatus and method of the present invention will be more clearly understood from the following description of operation. Referring to the drawings and particularly to FIGS. 6 and 8 which respectively show the process steps and the control circuit in block schematic diagrammatic, the user of the machine first deposits its collection of trash including containers into the machine at hopper 18. As pointed out above, the configuration of hopper 18 prevents the user from reaching into the interior of the machine to tamper with the machine and also reduces possible injury to the user. Once the collected containers are deposited in the hopper, the user depresses the starting switch 156 which initiates operation of the machine. Time delay 150 is actuated as well as motor control relay 152. Motor control 152 starts the motor of blower 70, crusher motor 78 and vacuum fan 29 and the motor of storage blower 136. Time relay 150 also actuates motor control relay 154 starting conveyor motor 48. Limit 160 is positioned at the discharge of the crusher and as material is discharged from the crusher, the limit switch 160 continually resets the time delay relay 150 as long as material is being processed and discharged from the crusher 30. If, after a predetermined time, as for example 40 seconds, no input signal from either switch 156 or limit switch 160 is received by relay 150, relay 150 deactuates the system. The machine then is only actuated in response to manual depression of button 156 and continues in operation as long as material is being processed through the machine.

Material is conveyed by conveyor 20 to magnetic separator 22. There ferrous material is held on the conveyor belt under the influence of magnetic elements of drum 44. Lighter debris is pneumatically removed under the negative pressure induced at the head of the conveyor by suction fan 29. Ferrous material is discharged from the conveyor onto separation plate 60 and discharged along passageway 62 into container or bin 24. The remaining material is discharged into pneumatic conveyor 26 at the inlet 66. The heavier material such as glass, sand and other debris falls into classification bin 28. The remaining material, mostly lighter, non-ferrous material such as aluminum containers is conveyed upwardly along pneumatic conveyor 26 and discharged into crusher 30 where the action of crushing drum 76 reduces the size of the containers. Shredding may also be accomplished at this step. The crushed material is then deposited through chute 84 into weighing hopper 32. Weighing of material received in the hopper is continuous during the cycle. Load cell 120 provides a signal of predetermined voltage per increment of weight. When the amplifier is in the sample mode, the input and output are equal. Limit relay 164 closes when the input/output differential of the sample and hold amplifier 162 reaches a predetermined voltage. The closure resets the sample and hold amplifier 162 and provides an electrical signal to the ticket dispenser 34 to issue appropriate compensation. Relay 164 also steps the stepping relay 168 one position. Signal conditioning amplifier 161 provides a voltage excitation to the load cell and outputs, for example, a 0–10 volt signal which is equivalent to a predetermined weight range.

The weight may also be accumulated and totaled by electronic logic and the compensation issued all at once rather than continuously as weighing occurs. A digital or other visible read-out of the total weight and/or compensation may be displayed to the user.

Stepping relay 168 computes the compensation issued and starts the hopper dump timer 170 when appropriate compensation has been issued. For example, if dispenser 34 is issuing tokens or tickets, the stepping relay 168 determines the number of tokens or tickets issued and initiates the hopper dump cycle when a predetermined number of tickets or coupons are issued. Typically, the hopper dump cycle would be initiated, for example, when ten coupons have been issued and two pounds of material weighed. When the dump cucle is initiated, the dump cycle timer 170 stops the conveyor motor 48. After a predetermined interval the sample and hold amplifier 162 is set. Solenoid 110 is actuated releasing latch 116 causing hopper door 102 to open and dump the contents of the hopper into the subjacent chamber 130. After a predetermined period, solenoid 106 is actuated causing linkage 108 to pivot door 102 to a closed position and latch 116 is re-engaged. The system remains inactive for another predetermined period to allow the hopper to "settle-out" so that movement or vibrations of the hopper 32 do not affect the system or give false readings. Dampening devices 124 are also provided for this purpose. After the predetermined delay motor control relay 154 is actuated and conveyor motor 48 restarted, the cycle is repeated and continues until either the crusher limit switch 160 no longer senses material in the machine or the on switch 156 is not again depressed.

Material discharged from the scale hopper 32 is conveyed via duct 36 to the upper end of overhead storage bin or compartment 16. Material in the bin has now been segregated, crushed and weighed. The material is free of extraneous materials such as ferrous materials, glass bottles and containers, trash, debris and dirt. The segregated material can be transported to a factory for re-use. Dumping of the storage compartment 16 is facilitated by the position and orientation of the compartment. The compartment is inclined from the upper end downwardly towards a rear unloading door 140. Door 140 can be opened and the material will, under the influence of gravity, fall from the storage bin into a suitable collection bin or truck. Door 140 is preferably vented for release of pressurized air within the chamber.

Figure 9:
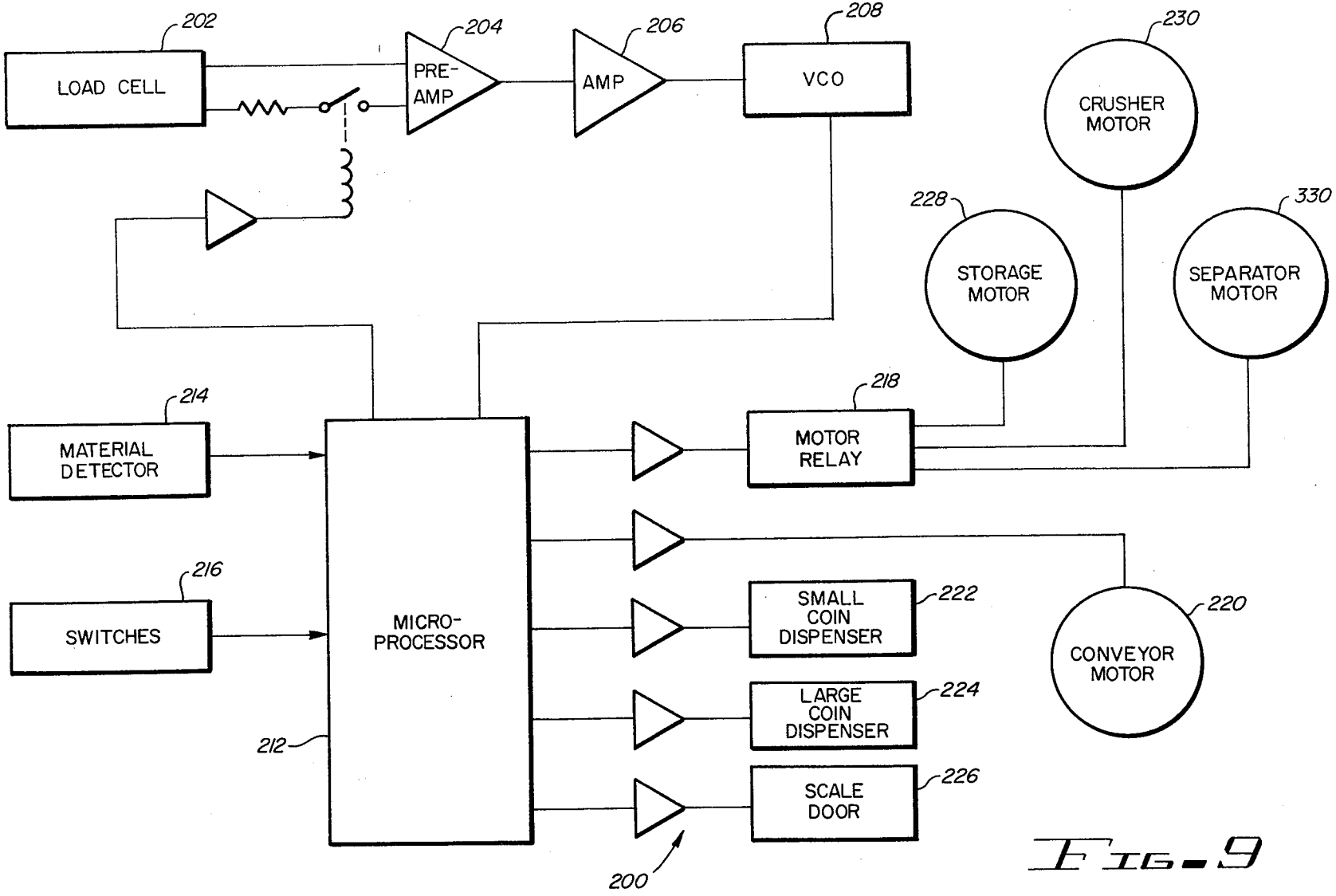
FIG. 9 is a schematic diagram illustrating an alternate control system.

An alternate form of control system which may be used in conjunction with the apparatus of the present invention is shown in FIG. 9. This system is generally designated by the numeral 200 and performs control functions similar to the system shown in FIG. 8 but utilizing solid state components. Control system 200 shown in FIG. 9 incorporates a load cell 202 which supports the weighing hopper 32 in the manner as has been described and shown with reference to FIG. 4. Similarly the load cell 202 may be of a conventional type as has been previously described. The output from load cell 202 is amplified at pre-amp 204 and amplifier 206 and the amplified signal is fed to the voltage control oscillator (VCO) 208. A calibration relay 210 biases or offsets the load cell 202 by a predetermined amount. Can detector 214 is located at the input of the apparatus as for example at hopper 18. Detector 214 typically is a photoelectric device which senses when the material is deposited within the hopper.

The main control functions are carried out by microprocessor unit 212. The microprocessor controls the motor relay 218, crusher motor 230, conveyor motor 220, separator motor 330 and coin dispensers 222 and 224 which preferably dispense coins of different amounts as for example, large and small coins. Typically dispenser 224 controls and dispenses dimes while dispenser 222 dispenses coins in a lesser amount as for example pennies.

The opening of the scale door 226 on the weighing hopper is also controlled by the microprocessor 212. The scale and hopper arrangement is generally as has been previously shown and described with reference to FIG. 4.

The control system 200 will be more completely understood from the following description of operation. As material is fed into the recycling apparatus, detector 214 senses the presence of material and sends a signal to the microprocessor 212. Microprocessor 212 enables the motor relay 218 and conveyor motor 220 to start the machine. Separation takes place as has been described and separated material is deposited into the hopper suspended from load cell 202. After a settling time, the microprocessor reads the frequency from the voltage control oscillator 208. The frequency of VCO 208 is proportional to the weight of material within the hopper as the load cell 202, through amplifiers 204 and 206, is connected to the input of the VCO 208. Microprocessor 212 enables the calibration relay which offsets the loadcell 202 by a calibrated amount. This allows the microprocessor 212 to compute a gain coefficient for the analog circuit including the load cell, pre-amp, amplifier and VCO.

As material falls into the hopper, the microprocessor 212 computes the weight of the material. When a predetermined quantity of material has collected in the hopper, the microprocessor stops the conveyor motor 220. This prohibits any more material from reaching the weighing hopper. The microprocessor 212 then calculates the weight and computes the amount of compensation to be paid. The amount paid per unit of weight, as for example per pound, can be adjusted at switches 216. The microprocessor then actuates the coin dispenser 224. When the compensation has been paid by dispenser 224, the microprocessor actuates the scale door latch 226 which allows the scale hopper to unload. The scale is then allowed to settle and calibration is repeated. The microprocessor reads the frequency from the VCO 208 and establishes tare. The microprocessor enables calibration relay 210 to offset the load cell by a calibrated amount. The microprocessor 212 computes a gain coefficient for the analog circuit. The conveyor motor 220 is then started and the process is repeated.

When the user has completed depositing materials into the machine, the microprocessor 212 makes a final reading of the scale and pays any remaining compensation due actuating either compensation dispenser 222 or 224 or both. Once the transaction is completed and all materials are discharged from the hopper and detector 214 does not sense the presence of any additional materials, all motors are turned off.

As pointed out above, it is within the spirit and scope of the present invention to dispense any type of compensation for materials collected and weighed. For example, paper coupons could be issued which would be redeemable by merchants. Similarly, tokens or coins could be dispensed which also would be redeemable by merchants when a purchase is made. Compensation may also be in the form of currency or coins.

Further, it is within the scope of the present invention to eliminate the crushing operation within the machine. For example, crusher 30 could be eliminated and the discharge from pneumatic conveyor 26 could be directly fed into weighing hopper 32. In all other respects, the construction and the operation of the machine would be as described above. In the event the crushing step is eliminated as part of the machine it would be desireable to provide a crushing step in the collection operation. Material collected by collection vehicle from storage bin 16 could be crushed, shredded or reduced in size as it is received in the collection vehicle. The advantage of this system is that a single crusher would service a number of collection machines reducing cost and maintenance from the individual machines.

As can be appreciated from the foregoing, the collection device of the present invention can be operated to collect and segregate materials of a specified type. One primary use of the present machine is to segregate aluminum containers from a mixed collection and aggregation of trash so that the aluminum can be recycled or re-used. A significant advantage of the collection machine of the present invention is that the machine dispenses compensation in response to weight of material recovered by the machine. This is in direct contrast to many prior art devices which issue a token based on count of containers delivered to the machine. The weight of containers varies considerably and dispensing compensation or a token based on count is inaccurate.

The present machine also represents an advance in the state of the art in that a mixed collection of containers can be placed in the machine and the machine automatically segregates those containers of a certain type which are to be recycled. The extraneous containers and debris are automatically separated by the machine for disposal. The machine of the present invention is simple and reliable. The overhead storage of recovered containers is advantageous in that unloading of the recovered containers to a collection bin is facilitated. As pointed out above, the apparatus of the present invention can be adapted to dispense any kind of remuneration or compensation including coupons, tokens or coins or currency. In the event coupons are dispensed, validation of the coupons as they are issued may also be incorporated in the dispensing device. This may be done by perforating the coupons or by subjecting the coupons to the imprinting or developing by chemical or light exposure to validate the tickets.

The design of the unit is adapted for convenient transportation. For example, the overhead compartment 16 and control panel 32 are designed to be removed from the main body of the apparatus to facilitate shipping in knocked-down condition by conventional carriers without special permits. This modular concept also facilitates erection and maintenance of the equipment.

It will be obvious to those skilled in the art to make various changes, alternations and modifications to the embodiments herein chosen for purposes of illustration. To the extent that these changes, alterations and modifications do not depart from the spirit and scope of the appended claims they are intended to be encompassed therein.

I claim:

1. An apparatus for receiving trash and recovering metallic containers of a pre-selected type from said trash, said apparatus comprising:

(a) a frame;

(b) an inlet hopper for receiving said trash;

(c) first conveyor means located to receive the discharge from said inlet hopper;

(d) magnetic means for retaining ferrous materials on said first conveyor means to convey said ferrous materials to a first location and discharge said nonferrous materials at a second location;

(e) pneumatic conveying means communicating with said second location for conveying materials of predetermined specific weight to a third discharge location;

(f) crushing means receiving material from said third discharge location for reducing the size of materials received;

(g) weighing means receiving discharge from said crusher means;

(h) load cell means responsive to said weighing means and operatively connected to means for issuing compensation related to the weight of material weighed;

(i) control means for regulating the flow of materials into said weighing means during a weighing cycle and for dumping said means upon completion of said weighing cycle;

(j) a microprocessor unit and analog circuit means operatively connected to said load cell, control means, weighing means and means for issuing compensation for establishing zero tare when weighing cycle is initiated; and (k) second conveying means for receiving the discharge from said weighing means and conveying same to a storage compartment.

2. The apparatus of claim 1 wherein said means for issuing compensation comprises a multiple denomination coin dispenser and wherein said weighing means includes means for making a final determination at the completion of weighing cycle and dispenses the balance of any coins due the user.

* * * * *